US005812112A

United States Patent [19]

Helfferich

[11] Patent Number: 5,812,112

[45] Date of Patent: Sep. 22, 1998

[54] METHOD AND SYSTEM FOR BUILDING BIT PLANE IMAGES IN BIT-MAPPED DISPLAYS

[75] Inventor: Johan Hendrikus Helfferich, Hengelo, Netherlands

[73] Assignee: Fluke Corporation, Everett, Wash.

[21] Appl. No.: 624,017

[22] Filed: Mar. 27, 1996

[51] Int. Cl.[6] ..... G09G 5/36

[52] U.S. Cl. ..... 345/134; 345/113; 345/116; 345/509

[58] Field of Search ..... 345/131, 133, 345/134, 149, 440, 87, 94, 98, 112–118, 509, 515, 191; 364/481–487, 550, 551.01, 267, 267.1–267.6

[56] References Cited

U.S. PATENT DOCUMENTS

| | | | |
|---|---|---|---|
| 4,914,607 | 4/1990 | Takanashi et al. | 345/344 |
| 4,951,229 | 8/1990 | DiNicola et al. | 345/473 |
| 5,081,592 | 1/1992 | Jenq | 345/146 |
| 5,231,385 | 7/1993 | Gengler et al. | 345/153 |
| 5,254,979 | 10/1993 | Trevett et al. | 345/113 |
| 5,347,624 | 9/1994 | Takanashi et al. | 345/435 |
| 5,517,105 | 5/1996 | Holzwarth | 345/131 |
| 5,530,454 | 6/1996 | Etheridge et al. | 345/134 |
| 5,668,469 | 9/1997 | Natori et al. | 364/487 |
| 5,684,508 | 11/1997 | Brilman | 345/134 |

OTHER PUBLICATIONS

"E–1330 LCD Controller IC Application Manual", pp. 1, 28–33, and 38–39, Seiko Epson Corp., Mar. 1992, Japan.

*Primary Examiner*—Matthew M. Kim
*Assistant Examiner*—U. Chauhan
*Attorney, Agent, or Firm*—George T. Noe

[57] ABSTRACT

In a measurement instrument, a display processor system and method for efficiently building a display image on a bit-mapped liquid crystal display are provided. The display processor system contains a set of bit plane images corresponding to predetermined images such as figures, menus, axes for a graphical plot, and other commonly needed images. Because the bit plane images are already processed and defined, operating on the display image becomes a simplified, high-level operation in which the desired image is constructed according to a display operation sequence. Virtual trace bit plane images are also employed to accommodate incoming measurement values which are appended to measurement traces, thereby causing the measurement traces to change rapidly. Virtual bit planes skip the intermediate step of constructing an entire bit plane image so that the displayed image may be more rapidly updated with the changing measurement traces. The burden on the instrument microprocessor of building and then rebuilding a display image on the bit-mapped display is thus minimized.

12 Claims, 7 Drawing Sheets

METHOD AND SYSTEM FOR BUILDING BIT PLANE IMAGES IN BIT-MAPPED DISPLAYS

BACKGROUND OF THE INVENTION

This invention relates generally to electronic display systems and in particular to a display processor system in an electronic measurement instrument which provides an efficient method of building displayed images on a bit-mapped liquid crystal display.

Electronic displays include, among others, cathode ray tubes (CRT's), electroluminescent displays, and liquid crystal displays (LCD displays). An image generated on any of these displays is a collection of individual graphic elements called pixels, all of which may be controlled by the computer or microcontroller in terms of color and intensity. A bit-mapped display is a type of visual display comprising a collection of individual pixels arranged in rows and columns, with each individual pixel controllable by a unit of pixel data stored at a corresponding display memory location. Creating a display image is thus done by controlling the display information.

LCD displays have become an integral part of modern test and measurement equipment generally and are particularly well suited for use in portable, hand-held measurement instruments. LCD displays function both as a user interface, often in conjunction with user-defined softkeys, and as a display of measurement information, typically in the form of graphical traces. Such multiple purposes have required the use of LCD displays with increasingly higher resolution so that both user interface information and measurement information may be displayed simultaneously. Obtaining a higher resolution image requires more pixels which increases the processing requirements of the microprocessor. At the same time, the microprocessor must perform other important tasks. For example, incoming measurement values must be processed as they arrive and the measurement instrument must react to key presses from the instrument user.

A significant processing burden on the microprocessor is the task of building a display image on the LCD display. When new information arrives, typically as user interface information or as measurement information, the display image must be built again, which requires calculating new display data for the intensity and possibly the color of each pixel. For example, when a user presses a key on the keypad and a menu box must appear on the LCD display in response, the pixels of the LCD display associated with the menu box must be programmed with the menu box image. At the same time, the information that was displayed in the menu box area must be saved and then recalled after the menu box disappears, for example after a menu item in the menu box has been selected, and the previous display image is built again. If constraints on power consumption and cost permit, a more powerful microprocessor or separate microprocessors may be selected to handle the measurement instrument control and display control tasks.

The display processing burden has been reduced through the use of display controller integrated circuits which are special-purpose microprocessors. The E-1330 from Seiko Epson Corporation is a display controller integrated circuit that allows the use of up to three overlapping graphical images or bitplanes which may be combined using a set of display operations including the logical operations of AND, OR, and XOR, among others. Each bitplane image requires a separate display random access memory (RAM) for storage. The display controller then combines the outputs of the display RAM's simultaneously for each bit plane image according to a display operation to obtain a display image. However, the processing burden on the instrument microprocessor remains substantial because the display RAM's must be frequently updated to build new images. This problem is particularly acute in measurement instruments that process and display a continuous stream of incoming measurement as graphical traces, requiring constant updating of the stored bit plane images.

Therefore, in a battery-operated, portable measurement instrument, it would be desirable to provide a more efficient method of building images on a bit-mapped LCD display which minimally burdens the instrument microprocessor. It would be further desirable that method of a display image be readily extendible to multiple bit plane images to provide more flexibility in sequentially building display images and to readily allow the inclusion of graphical traces in the display image.

SUMMARY OF THE INVENTION

In accordance with the present invention, a display system and method for efficiently building a display image on a bit-mapped LCD display are provided. A display memory contains the display data necessary for creating images using the pixels of a bit-mapped LCD display. The display system further contains a set of bit plane images. Each bit plane image is a collection of display data corresponding to predetermined images such as figures, menus, axes for a graphical plot, and other commonly needed images. Bit plane images may cover any portion of the LCD display up to the entire display image area. The display system also contains a series of measurement values collected by the measurement instrument which stored in an array in the display memory which may be plotted as graphical traces in bit plane images and then imposed on the display image like other bit plane images.

Each bit plane image may be used to sequentially operate on the display image according to a set of display operations. Because the bit plane images are already processed and defined, operating on the display image becomes a simplified, high-level operation in which the pixel by pixel operations between the display image and the bit plane image are performed within the display processor with little intervention from the microprocessor. Display operations that may be performed include set, nop (meaning "no operation"), mask, and invert. The overall intensity of each bit plane image or trace may be controlled according to an attribute set which includes off, gray, and dark. As an example, starting with a blank display image in the LCD display in which all the pixels are off, the set operation may be used to impose a set of grid lines from a predetermined bit plane image containing a grid line image. Another set operation imposes graphical labels on the display image from another bit plane image containing a graphical label image. A further set operation imposes a graphical trace on the now labeled grid lines in the display image using a bit plane image which contains the already plotted graphical traces.

The display image is built using a display operation sequence which specifies a selected set of bit plane images and an associated set of display operations which operate on the display image. The display operation sequence operates continuously to build the display image over and over as a series of frames. Bit plane images are predetermined and stored in the display memory to be recalled as needed. When the display image must be changed to a new display image, a new display operation sequence is selected to build the new display image. For example, as a key on the front panel of the measurement instrument is pressed which requires that a menu box be displayed, a mask operation using a bit plane containing a mask image may be used to erase or reset a selection portion of the display image.

A set operation imposes a menu box on the area just cleared by the mask operation using a bit plane image containing an image of the menu box. To make the box disappear, the mask and set operations on the bit plane images that form the box are removed from the sequence by replacing them with "nop's". In this way, the respective bit plane images are turned off. Because the display image is continuously rebuilt as successive frames, each frame according to the display operation sequence, the box is thus made to disappear. The architecture according to the present invention is readily extendible to include a larger number of bit plane images because the bit plane images are applied serially according to the display operation sequence.

The fundamental limitation to the number of bit plane images that may be employed for a given display image is determined both by the processing speed of the display processor and by the access speed of the display memory devices. As more bit plane images are combined, the time needed to complete the display image increases. The data from each bit plane image may be applied to the display image either as an entire bit plane image simultaneously, or, as in the preferred embodiment, in discrete bytes (8 bits), with each byte controlling eight pixels of the display. Each corresponding byte from each bit plane image is selected according to the display operation sequence. The entire set of eight pixel groups comprises a frame to form the display image. After one frame is complete, the next frame may begin, either using the same display operation sequence as the previous frame or a new display operation sequence if a new display image is desired, such as in response to a key press.

At the same time, there is no practical limit on the number of bit plane images which may be stored in the display memory. Any given display image may be constructed using a display operation sequence which draws upon only a selected subset of the total available bit plane images stored in display memory. Thus, a display image may be rapidly reconfigured with only a minor change to the display operation sequence by substituting one bit plane image for another in the display operation sequence. For example, a grid on the display image for plotting a measurement trace may quickly be changed to a simple pair of X and Y axes simply by swapping the appropriate bit plane images chosen by the display operation sequence. Such a change physically involves only a change in the memory locations accessed within the display memory according to the display operation sequence but results in an entirely new graphical display format on the display image, thus minimizing the load on the instrument microprocessor.

In the manner described above, the burden on the microprocessor of building and then rebuilding a display image on the LCD display is minimal because the display processing activity can be done in the display processor circuits which are adapted for that task. Building display images in terms of predefined bit plane images and a set of simple display operations thus frees the microprocessor to perform measurement and instrument control functions without the burden of processing each pixel. At the same time, the display processor circuits operate efficiently, consume relatively little power, and may be implemented with conventional digital logic circuits.

An additional display processing operation which is particularly applicable to measurement equipment is the graphical display of measurement information as measurement traces on the instrument display. While menu boxes, labels, and axes are static parts of the display image that tend not change very often, the measurement traces tend to change very often and are thus dynamic in nature. Measurement information typically arrives at regular intervals over time and must be added to the measurement information already being displayed in the form of measurement traces.

To better handle the dynamic nature of measurement traces, trace bit plane images are employed which are virtual, meaning the trace bit plane image does not occupy physical memory space. The trace plane images are virtual in that the image is constructed as needed in the trace processor, without storing the trace image in display memory as an intermediate step. A trace processor plots each measurement trace to designated virtual trace plane image which may contain a number of different measurement traces. The trace processor also handles the details of formatting each measurement trace such as connecting adjacent dots to give the graphical plot a smooth look. Because the trace planes images may be placed anywhere within the sequence in building the display image and with a selectable size and location within the display image, the burden of creating and quickly updating a displayed image is minimized. Because the trace bit plane image is virtual, the display image readily changes from frame to frame to display the updated measurement traces without having to change the display operation sequence.

One object of the present invention is to provide a method of efficiently building display images on a bit-mapped display.

Another object of the present invention is to provide a method of efficiently building display images on a bit-mapped display using bit plane images.

A further object of the present invention is to provide a method of efficiently building display images and plotting measurement traces of measurement information on a bit-mapped display using bit plane images in a display operation sequence.

An additional object of the present invention is to provide a display system containing display processing circuitry for efficiently building display images on a bit-mapped display using a set of bit plane images and a set of trace plane images in a display operation sequence.

Other features, attainments, and advantages will become apparent to those skilled in the art upon a reading of the following description when taken in conjunction with the accompanying drawings.

DETAILED DESCRIPTION OF THE INVENTION

Figure 1:
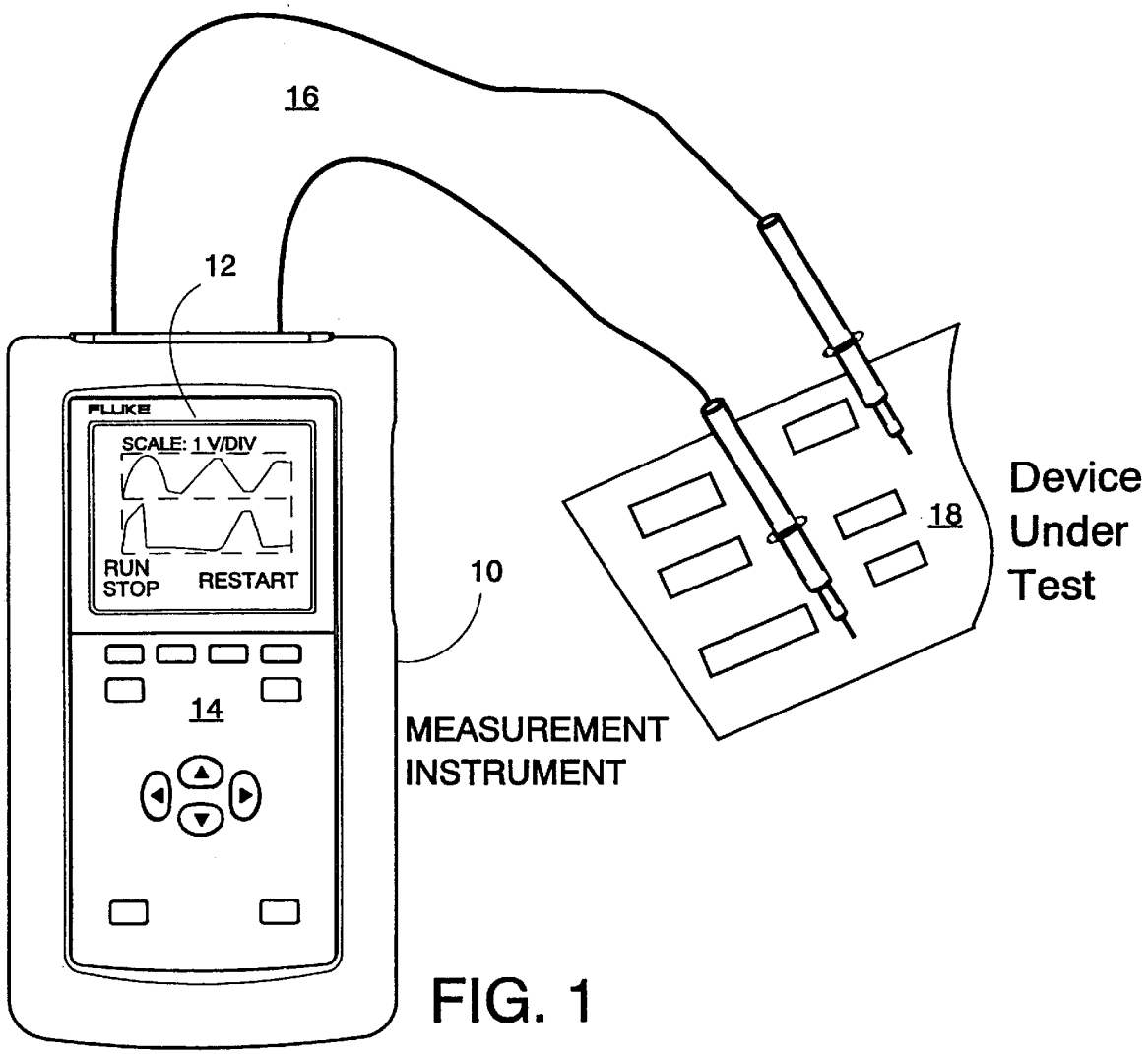
FIG. 1 is a graphical depiction of a measurement instrument as applied in measuring a device under test and containing a display processor system according to the present invention.

FIG. 1 is graphical depiction of a measurement instrument 10 having a display 12 and keypad 14 and containing a display processor system according to the present invention. The measurement instrument 10 is designed to be a battery-operated, portable instrument to be used in service, installation, and maintenance applications. The overall design goal of achieving a battery-operated, portable measurement instrument imposed the design constraints of minimal power consumption, small physical size, and low manufacturing costs on the display processor system. Such design constraints limit the ability of the instrument designer to employ multiple microprocessors to handle the instrument control and display control tasks separately or to employ a single, more powerful microprocessor to handle all of the tasks together. A display processor system reduces the processing burden of controlling and updating the display image in order to meet the above-mentioned design constraints by allowing a less powerful microprocessor to be used in combination with special purpose digital integrated circuits.

The measurement instrument 10 is coupled via test leads 16 to a DUT (device under test) 18 in a typical application. In the preferred embodiment, the display 12 is comprised of a bit-mapped LCD display with pixels arranged as a grid of 240 rows by 240 columns for a total of 57,600 pixels. The intensity of each pixel may be controlled as discrete levels, including off (light), gray, and dark. Shown in the display 12 is a display image containing both measurement information and user information. The display image is formed by programming the intensity of the appropriate pixels. The keypad 14 and the display 12 together comprise the user interface of the measurement instrument 10. As keys on the keypad 14 are pressed, the display 12 changes in response according to the user interface program that the measurement instrument 10 is executing. Measurement values obtained from measuring the DUT 18 may be shown graphically as measurement traces in the display 12, with the graphical traces rapidly updated on the display image as new measurement values arrive.

Figure 2:
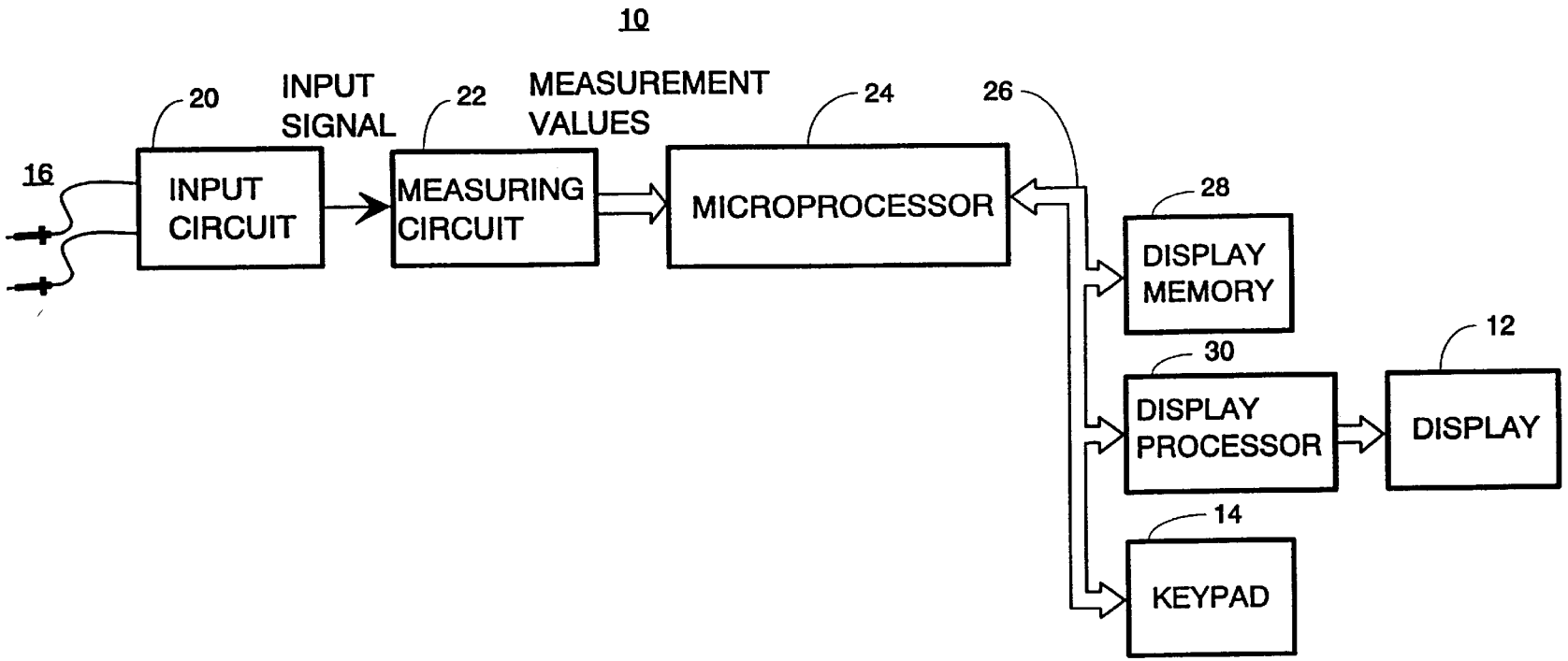
FIG. 2 is a block diagram of the measurement instrument and display processor system of FIG. 1.

FIG. 2 is a simplified block diagram of the measurement instrument 10. The test leads 16 are coupled to an input circuit 20 which may contain amplifiers, attenuators, filters, and other circuits for obtaining an input signal having characteristics acceptable for further measurement. A measuring circuit 22 is coupled to the input circuit 20 to receive the input signal and convert it to measurement values. Each measurement value is a digital representation of the input signal taken at a given time which may be stored and manipulated digitally. Measuring circuit 22 may be comprised of an analog to digital converter (ADC), a frequency counter/timer, a digitizer, or any other measurement circuit capable of producing measurement values from the input signal. Over time, the measuring circuit 22 may produce a stream of measurement values obtained at regular intervals.

A microprocessor 24 is coupled to the measuring circuit 22 to receive the measurement values. The microprocessor 24 is further coupled via an interface bus 26 to a display memory 28, a display processor 30, and the keypad 14. The microprocessor 24 processes the measurement values by placing them in the display memory 28 in the form of an array, typically in time order to form a measurement trace so that a time history of measurement values may be built. Display images on the display 12 may be built in an efficient manner by the display processor 30 as controlled by the microprocessor 24 to quickly adapt to changes in the measurement traces and to key presses received from the keypad 14 as explained below. The display 12 is coupled to the display processor 30 to receive pixel data and update information for controlling the display image. The display processor system is comprised of the display processor 30, the display memory 28, and the display 12.

Figure 3A:
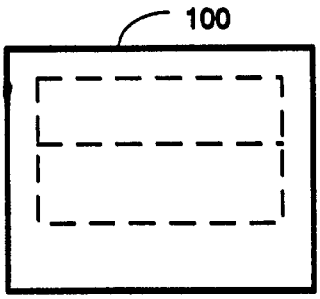
FIG. 3A–I together illustrate an exemplary set of bit plane images which may be contained in the display processor system of FIG. 1.
Figure 3B:
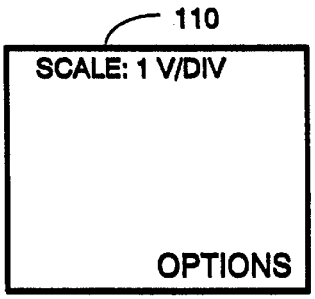

FIG. 3A–I together illustrate a set of bit plane images which may be contained in the display memory 28. The bit plane images as shown were chosen for purposes of illustration and example and not for limitation. The bit plane images physically exist as collections of display data stored in the display memory 28 which may be recalled by the display processor 30 as they are needed. Each of the bit plane images shown in FIG. 3A–I are the visual representation of the stored display images. In FIG. 3A, bit plane image 100 represents a set of axes for plotting a trace. In FIG. 3B, bit plane image 110 contains labels for the set of axes.

Figure 3C:
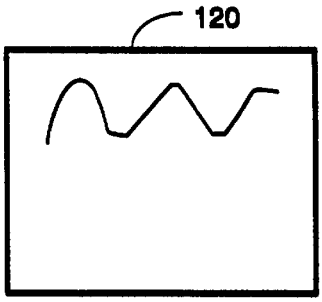
Figure 3D:
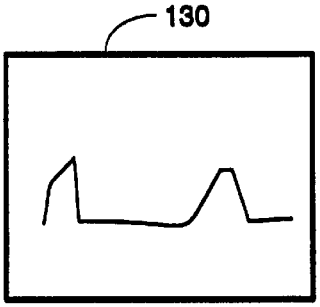
Figure 3E:
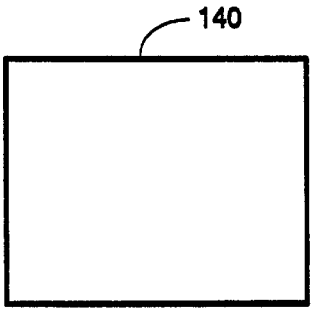
Figure 3F:
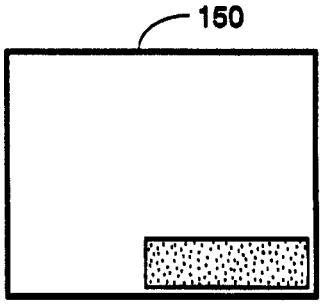
Figure 3G:
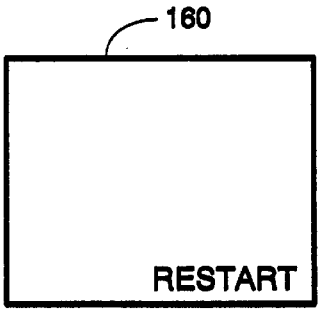
Figure 3H:
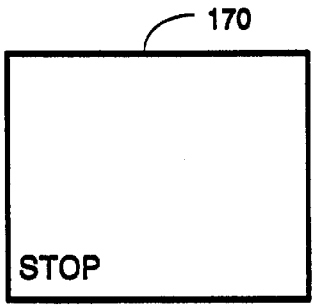
Figure 3I:
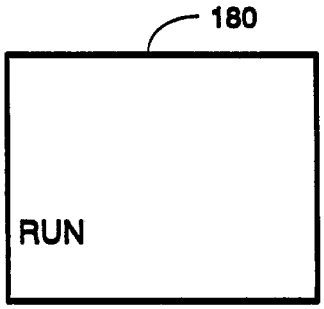

In FIG. 3C and 3D, trace bit plane images 120 and 130 are graphical plots of the measurement traces. In the preferred embodiment, the trace bit plane images 120 and 130 are virtual, in that the bit plane image is not actually stored in memory but provided by the trace processing operation as needed to the plane processing operation as further explained below. The trace bit plane images 120 and 130 are treated as bit plane images, although virtual, are processed in the same manner as the other bit plane images and may be inserted anywhere within the sequence to build the desired display image. In FIG. 3E, bit plane image 140 is a blank image not currently used. In FIG. 3F, bit plane 150 defines an area of the display which is to be erased or overwritten. In FIG. 3G, 3H, and 3I, bit plane images 160, 170, and 180 define labels corresponding to the user interface of the measurement instrument 10. Other sets of bit plane images may be readily designed and combined at will according to the requirements of what a desired display image looks like, the sequence of display operations needed to build the desired display image, and the user interface which determines what the desired display image will look like in response to key presses, the arrival of new measurement values, and other events.

Figure 4:
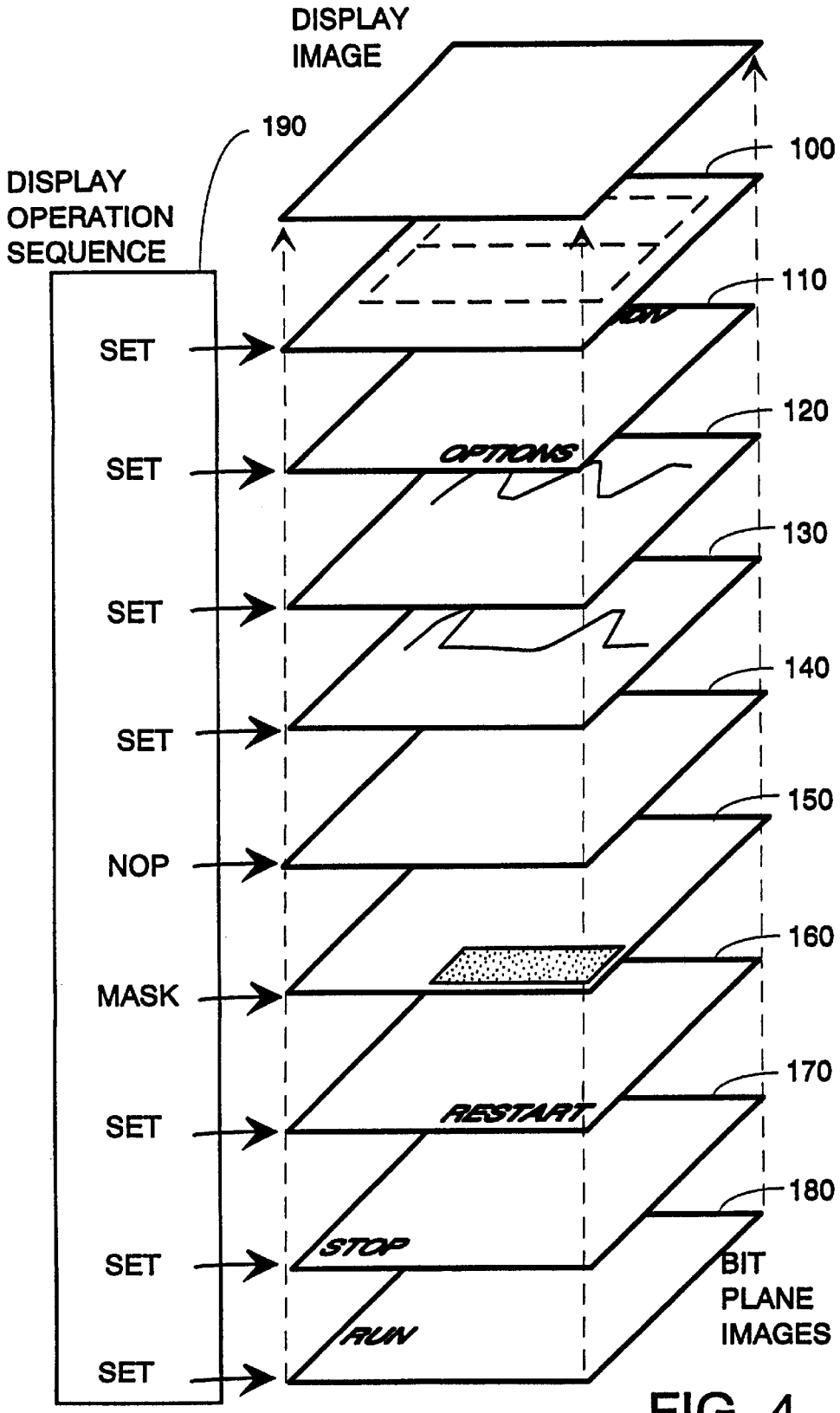
FIG. 4 illustrates a method of combining the set of bit plane images of FIG. 3 using a set of display operations on a displayed image.

FIG. 4 illustrates a method of building a desired display image using the set of bit plane images of FIG. 3 according to a set of display operations. As shown, the set of bit plane images 100–180 are stacked on top of one another to according a sequence of display operations. Each bit plane image is employed according to a display operation to operate on the display image in a sequential fashion. The order in which the operations occur and how each bit plane image operates on the display image determines what the display image looks like and is called a display operation sequence 190. Thus, the display operation sequence must be determined in conjunction with the set of bit plane images in order to consistently obtain the desired display image for each frame.

To illustrate the operation of the sequence of display operations to build a desired display image in a frame, assume that the displayed image initially is blank. The highest bit plane image in the stack, bit plane image 100, is employed first, with each bit plane image below bit plane image 100 applied below it as a higher order bit plane images. Using the set operation, the axes image in the bit plane image 100 is imposed on the displayed image. The pixel intensity is determined by a display attribute associated with each display operation. For example, "set black", not shown in FIG. 4, sets all of the pixels of the display image to black according to the bit plane image 100. To add labels on the axes, the set operation is performed again, but using the bit plane image 110 to impose the labels on the display image. Upper and lower graphical traces calculated from measurement traces and now virtually contained as the trace bit plane images 120 and 130 may be imposed on the display image using the set operation. Because the trace bit plane images 120 and 130 are virtual, no memory is used to store the entire image but the image information is provided by the trace processing operation as discussed below in more detail. Virtual trace bit plane images allow for more rapid updates of the displayed information because the intermediate step of building the trace plane image in display memory is eliminated, thereby reducing processing requirements, reducing display memory, and increasing the ability of the display processor to show measurement traces at high update rates.

Figure 5:
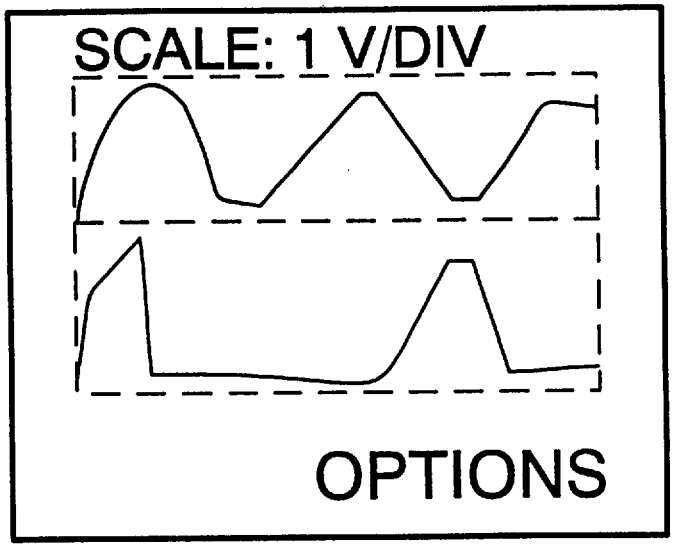
FIG. 5 illustrates a desired displayed image after a first set of operations using the set of bit plane images of FIG. 3.

FIG. 5 illustrates the display image as a result of a frame containing only the display operation sequence involving the bit plane images 100–130. Because the display 12 is being updated continuously, the present display image constituting a frame is constantly being built at a frame rate. A display operation sequence defined as the top four set operations of the display operation sequence 190 used in conjunction with a selected set of bit plane images 100–130 are repeated for each successive frame to obtain the desired image shown in FIG. 5. In the preferred embodiment, the frame is repeated at a rate of seventy times per second, but may be readily varied between fifty and one hundred times per second.

Figure 6:
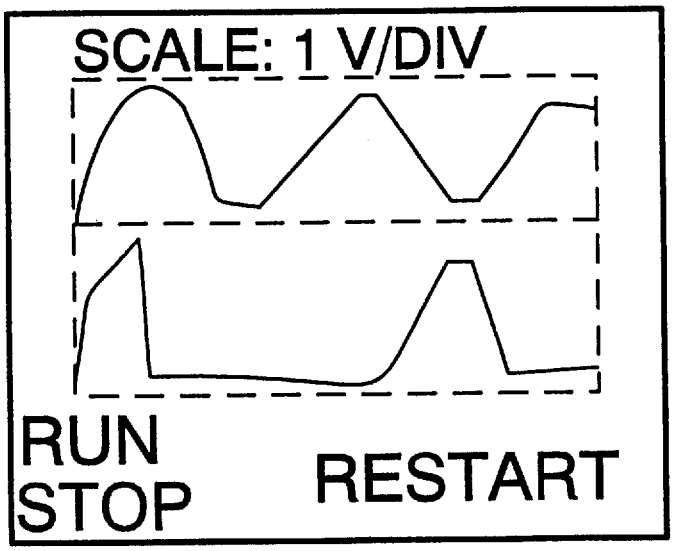
FIG. 6 illustrates the desired displayed image after a second set of operations using the set of bit plane images of FIG. 3.

FIG. 6 illustrates the display image as a result of the sequence of operations involving the bit plane images 100–180 which have occurred in response to the key press. In this manner, the display image has been rebuilt with a minimal amount of control from the microprocessor 24. The control required of the microprocessor 24 is typically limited to specifying the sequence of display operations and associated bit plane images to the display processor 30 in response to the key press received from the keypad 14.

Assume now that a key of the keypad 14 has been pressed. Responsive to the key press, the display image must now be rebuilt in accordance with the change in the operating condition of the instrument 10. The word OPTIONS must first be erased using the mask operation and the bit plane image 150 which defines the area to be masked over. The label RESTART is imposed on the just cleared area of the display image using the set operation and the bit plane image 160. The label STOP is imposed on the display image as a gray (half-intensity) image using the operation set in conjunction with the display attribute gray, "set gray", using the bit plane image 170. The label RUN is imposed on the display image using the operation set and the bit plane image 180. The desired display image is as shown in FIG. 6.

To accomplish this task of building the new desired display image, a new display operation sequence 190 is selected which uses a new selected set of bit plane images 100–180 as shown in FIG. 4. The virtual trace bit plane images 120 and 130 are members of the selected set of bit plane images. For each successive frame, the display operation sequence 190 is repeated to obtain the new desired image. It may be possible using a number of other permutations of display operations and bit plane images to achieve the same desired display image.

Figure 7:
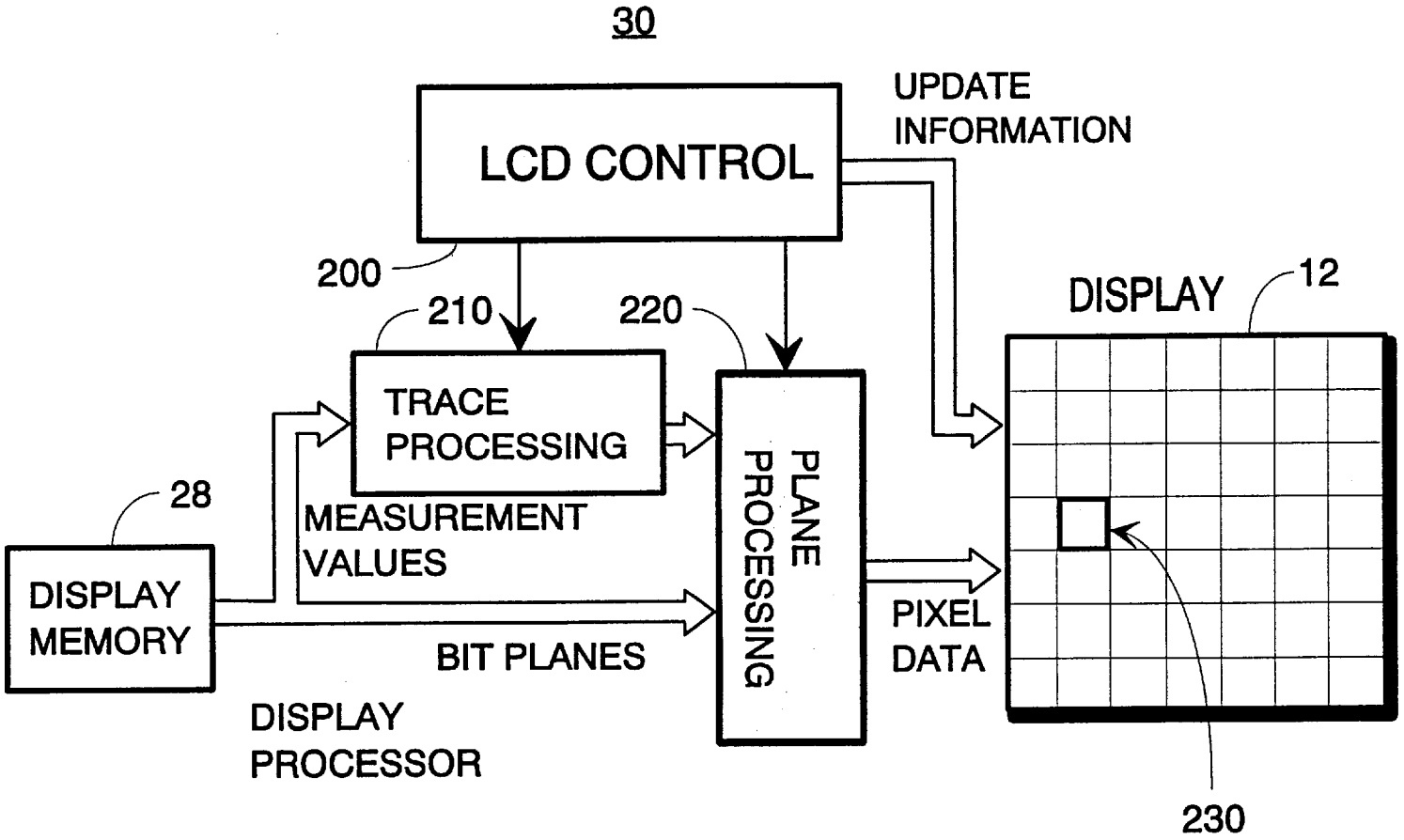
FIG. 7 is a block diagram showing the operation of the display processor system.

FIG. 7 is a block diagram showing the operation of the display system. The display processor 30 (shown in FIG. 2) is comprised of special purpose digital logic circuits that operate on the display images that appear on the display 12. The display memory 28 contains the set of bit plane images 100–180 (shown in FIG. 3A–I) along with the array of measurement values collected from the measuring circuit 22.

Each measurement value is appended to a set of measurement traces. Trace processing operation 210 provides pixel data according to virtual trace bit plane images for the display plane processing operation 220. Because each display image is built according as small groups of pixels, eight pixels in the preferred embodiment, and because the measurement traces are dynamic in nature, constantly changing and requiring quick updates, it is desirable to avoid building a complete trace bit plane image in display memory. Rather, each of the trace bit plane images is virtual in that a complete bit plane image corresponding to the trace bit plane is never assembled and stored in display memory. Rather, pixel data is calculated and provided by the plane processing operation 220 as needed by the display 12. The trace processing operation 210 provides trace bit plane image data to other processes as needed in a manner identical to that of a completed bit plane image. In this way, the advantages of speed in creating a desired display image are maintained using real bit plane images for static images such as labels and axes and virtual bit plane images for dynamic images such as measurement traces.

In formatting the measurement traces for display, the trace processing operation 210 may be programmed to scale the measurement traces according to a desired trace window which has a selectable size and location on the display 12. In the preferred embodiment, up to twelve measurement traces may be simultaneously maintained and assigned to one of two trace bit plane images. A dot join function of the trace processing operation 210 may provide for a continuous graphical plot by connecting each of the adjacent points of the graphical trace by turning on selected pixels. In this way, the burden of processing and formatting measurement traces from the measurement values remains entirely within the display processing operation 210.

The display operations are performed according to the plane processing operation 220 which receives selected bit plane images from the display memory 28 and trace bit plane image data from the trace processing operation 210. The plane processing operation 220 imposes the selected bit plane images on the display image according to the display operation sequence. Shown in display 12 is a simplified representation of pixels arranged in rows and columns. The completed display image is sent to the display 12 as pixel data which determines the intensity of each pixel. The area 230 represents a selected group of pixels, ranging from as few as one to pixel to as many as the entire number of pixels of the display image. Each area 230 of the display 12 contains pixels that are addressable sequentially using display drivers commonly available for bit-mapped LCD displays. In this way, the display 12 is commonly understood to be a bit-mapped display. The number of pixels in the area 230 determine the amount of pixel data that must be processed simultaneously. As explained below, the area 230 comprises eight pixels in the preferred embodiment, corresponding to one byte of pixel data.

Each display operation involves only manipulation of display data stored in corresponding memory locations, thus treating display images and bit plane images as discrete blocks of data which are relatively efficient to process. The information contained in each bit plane image has the same relative memory location within the display memory 28 to simplify the plane processing operations. Fewer bus operations are required and display images with a relatively large number of pixels may therefore be accommodated. The display processor 30 thus meets the constraints of low manufacturing cost and low power consumption by selecting commonly available digital logic circuits that need not operate at high speeds. The display operations are performed efficiently using static display images that have already been processed and stored as bit plane images. Virtual bit plane images of the measurement traces are continually processed and provided to the display processor so that any changes in the measurement traces appear on the display image during the next frame.

Figure 8:
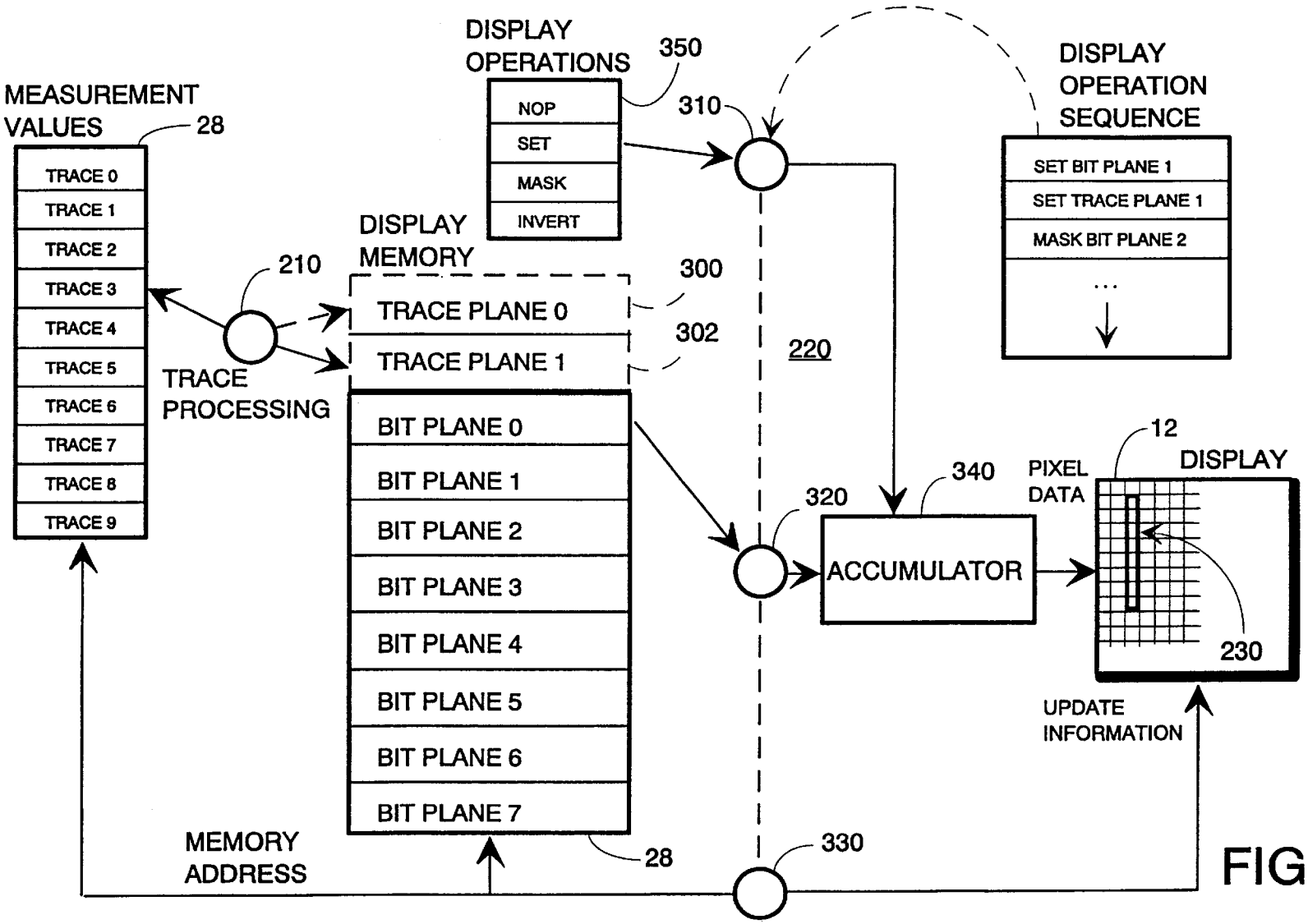
FIG. 8 is a block diagram showing in greater detail the operation of the display processor system according to the preferred embodiment.

FIG. 8 is a block diagram showing in greater detail the operation of the display processor system according to the preferred embodiment. Measurement values obtained from the measuring circuit 22 (shown in FIG. 2) are collected and stored in a set of measurement traces in the display memory 28. The trace processing operation 210 selects from the set of measurement traces and processes selected measurement traces to one of two trace bit plane images 300 and 302. The trace bit plane images 300 and 302 are virtual in that they occupy no physical memory space within the display memory 28 but the trace processing operation provides bit plane data according to a desired address in a manner identical to physical memory. In this way, a bit plane image for the entire trace need not be rebuilt every time a new measurement value arrives that changes the set of measurement traces.

The plane processing operation 220 as shown in FIG. 7 is comprised of processes 310, 320, and 330 and accumulator 340. Processes 310, 320, and 330 operate according to the display operation sequence 190 which determines a sequence of operations consisting of display operations and bit planes to build a display image. A set of display operations comprising NOP, SET, MASK, and INVERT 350 is provided which determine the manner in which a bit plane image operates on a display image. Responsive to the current display operation, the process 310 selects one display operation from the set of display operations 350 and provides that display operation to the accumulator 340. Also responsive to the current display operation, the process 320 selects one bit plane image from a set of bit plane images. Further responsive to the current display but not illustrated in FIG. 8, a display attribute of gray or black is used to determine the intensity of the bit plane image as seen in the display image.

The process 320 receives display data from the display memory 28 responsive to a memory address provided by the process 330. The display data is combined with the contents of the accumulator according to the display operation received from the process 310. The accumulator 340 now contains pixel data corresponding to the area 230 containing a selected set of pixels. Corresponding update information is provided by the process 330 to the display 12 which determines the area 230. In the preferred embodiment, the display data is received as a byte (8 bits), processed in the accumulator 340 against another byte of data, and then sent to the display 12 to a pixel address corresponding to the selected set of pixels 360 comprising eight pixels. The process 330 provides both the memory address for the display memory 28 and the corresponding pixel address for the display 12 to facilitate the proper transfer of pixel data for the area 230 of the display as each frame is built.

It will be obvious to those having ordinary skill in the art that many changes may be made in the details of the above described preferred embodiments of the invention without departing from the spirit of the invention in its broader aspects. For example, other bit-mapped display technologies, such as vacuum fluorescent displays or graphical computer displays may also benefit from this method of efficiently building a display image. The method will work equally well for color and monochrome displays, the only difference being the additional pixel information required to store both hue and intensity levels for color displays. The display processor system as described was implemented with special purpose digital integrated circuits in the preferred embodiment but can be implemented with a microprocessor while maintaining the advantage of efficiency. Other methods of efficiently combining the bit mapped images in a block mode where the pixel data are related by a common addressing scheme may be employed equally well. Therefore, the scope of the present invention should be determined by the following claims.

What I claim as my invention is:

1. A method for building a display image on a bit-mapped display, comprising:

(a) storing a plurality of predetermined bit plane images in a display memory;

(b) selecting a set of bit plane images from said plurality of predetermined bit plane images according to a display operation sequence;

(c) sequentially recalling and processing said selected set of bit plane images according to said display operation sequence and a set of display operations to produce a set of display bit plane images; and (d) sequentially displaying said set of display bit plane images thereby to build a display image on said bit-mapped display.

2. A method for building a display image according to claim 1, wherein said set of display operations comprises set, mask, nop, and invert.

3. A method for building a display image according to claim 1, further comprising:

(a) appending an incoming measurement value to a set of measurement traces; and (b) processing said measurement traces as a virtual trace bit image wherein said virtual trace bit plane image is a member of said selected set of bit plane images.

4. A method for building a display image according to claim 3 wherein said virtual trace bit image has a selectable size and location on said desired display image.

5. A method for building a display image according to claim 1 further comprising:

building said display image as a frame; and continually repeating said frame at a frame rate.

6. A method for building a display image on a bit-mapped display, comprising:

(a) storing a plurality of predetermined bit plane images in a display memory;

(b) creating a set of measurement traces from an incoming stream of measurement values;

(c) processing said measurement traces to produce a virtual trace bit image;

(d) selecting a set of bit plane images from said plurality of predetermined bit plane images and said virtual trace bit plane image according to a display operation sequence;

(e) sequentially recalling and processing said selected set of bit plane images according to said display operation sequence and a set of display operations to produce a set of display bit plane images; and (f) sequentially displaying said set of display bit plane images thereby to build a display image on said bit-mapped display.

7. A method for building a display image according to claim 6 wherein said virtual trace bit image has a selectable size and location on said desired display image.

8. A method for building a display image according to claim 6 wherein said set of display operations comprises set, mask, nop, and invert.

9. A method for building a display image according to claim 6 further comprising:

building said display image as a frame; and continually repeating said frame at a frame rate.

10. A display processor system for building a display image, comprising:

(a) a display memory for storing a set of measurement traces and a set of bit plane images wherein new measurement values are appended to said measurement traces;

(b) a trace processor coupled to receive said set of measurement traces from said display memory, said trace processor providing a virtual bit plane image of at least one of said set of measurement traces;

(c) an accumulator coupled to selectively receive bit plane image data from said trace processor and from said display memory according to a display operation sequence, said accumulator sequentially operating on a display image to build a display image; and (e) a bit-mapped display coupled to said accumulator to receive and visually display said display image.

11. A display processor system for building a display image according to claim 10 wherein said desired display image is constructed during a frame and said frame is constructed from groups of pixels operated on according to said display operation sequence.

12. A display processor system for building a display image according to claim 11 wherein each of said bit plane image data is one byte in length to control each of said groups of pixels.

* * * * *